US009564683B2

(12) United States Patent
Won

(10) Patent No.: US 9,564,683 B2
(45) Date of Patent: Feb. 7, 2017

(54) MULTI BAND ANTENNA DEVICE AND WIRELESS COMMUNICATION DEVICE INCLUDING MULTI BAND ANTENNA

(71) Applicant: Samsung Electronics Co., Ltd., Suwon-si, Gyeonggi-do (KR)

(72) Inventor: Youn-Su Won, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 161 days.

(21) Appl. No.: 14/264,372

(22) Filed: Apr. 29, 2014

(65) Prior Publication Data

US 2014/0327587 A1 Nov. 6, 2014

(30) Foreign Application Priority Data

May 2, 2013 (KR) ..... 10-2013-0049154

(51) Int. Cl.

| | |
|---|---|
| ***H01Q 21/30*** | (2006.01) |
| ***H01Q 5/00*** | (2015.01) |
| ***H01P 1/213*** | (2006.01) |
| ***H01Q 1/24*** | (2006.01) |
| ***H01Q 5/335*** | (2015.01) |
| ***H01Q 5/50*** | (2015.01) |
| ***H01Q 21/28*** | (2006.01) |

(52) U.S. Cl.

CPC ..... *H01Q 5/0093* (2013.01); *H01P 1/213* (2013.01); *H01Q 1/243* (2013.01); *H01Q 5/335* (2015.01); *H01Q 5/50* (2015.01); *H01Q 21/28* (2013.01); *H01Q 21/30* (2013.01)

(58) Field of Classification Search

CPC ..... H01Q 5/50; H01Q 5/335; H01Q 21/28; H01Q 21/30; H01Q 1/243

USPC ..... 343/702, 722, 852, 858

See application file for complete search history.

(56) References Cited

U.S. PATENT DOCUMENTS

| | | | | |
|---|---|---|---|---|
| 3,754,187 | A * | 8/1973 | Deming | G08C 19/14 340/13.26 |
| 5,760,747 | A * | 6/1998 | McCoy | H01Q 1/243 343/725 |
| 6,147,571 | A * | 11/2000 | Kitazawa | H03H 7/0123 333/126 |
| 8,098,202 | B2 | 1/2012 | Annamaa et al. | |
| 8,179,322 | B2 | 5/2012 | Nissinen | |

(Continued)

*Primary Examiner* — Dameon E Levi
*Assistant Examiner* — Ab Salam Alkassim, Jr.
(74) *Attorney, Agent, or Firm* — Jefferson IP Law, LLP

(57) ABSTRACT

A multi band antenna device which can simultaneously design a first frequency band antenna and a second frequency band antenna within one wireless communication device is provided. The multi band antenna device includes a first band antenna unit that communicates a first frequency band signal, a first band driving circuit unit that is connected to the first band antenna unit and that is configured to perform signal processing of a corresponding first frequency band signal communicated in the first band antenna unit, a second band driving circuit unit that is connected to the first band antenna unit, and that is configured to perform signal processing of a second frequency band signal which has a frequency that is lower than a frequency of the first frequency band signal, and a first inductor unit that is connected between one end of the first band antenna unit and the second band driving circuit unit, and that is configured to serve as an inductor.

7 Claims, 6 Drawing Sheets

(56) References Cited

U.S. PATENT DOCUMENTS

| | | | | |
|---|---|---|---|---|
| 2004/0046621 | A1* | 3/2004 | Furuya | H03H 7/0115 333/132 |
| 2009/0121948 | A1* | 5/2009 | Nysen | H01Q 1/2275 343/702 |
| 2010/0226354 | A1* | 9/2010 | Duzdar | H01P 1/213 370/339 |
| 2012/0034869 | A1 | 2/2012 | Rofougaran | |
| 2013/0154894 | A1* | 6/2013 | Caimi | H01Q 1/243 343/858 |
| 2013/0307742 | A1* | 11/2013 | Hu | H01Q 1/243 343/821 |

* cited by examiner

MULTI BAND ANTENNA DEVICE AND WIRELESS COMMUNICATION DEVICE INCLUDING MULTI BAND ANTENNA

CROSS-REFERENCE TO RELATED APPLICATION(S)

This application claims the benefit under 35 U.S.C. §119 (a) of a Korean patent application filed on May 2, 2013 in the Korean Intellectual Property Office and assigned Serial No. 10-2013-0049154 on, the entire disclosure of which is hereby incorporated by reference.

TECHNICAL FIELD

The present disclosure relates generally to an antenna device. More particularly, the present disclosure relates to a multi band antenna device which can simultaneously design a high frequency band antenna and a low frequency band antenna within one wireless communication device, and a wireless communication device including a multi band antenna.

BACKGROUND

Currently, various types of wireless communication devices such a smart phone, a tablet PC, a PC and the like are developed.

Such wireless communication devices require a plurality of antennas for communicating across each frequency band because the wireless communication devices have wireless communication systems such as Long Term Evolution (LTE) (e.g., 800 MHz, 1.8 GHz, 2.1 GHz, 2.6 GHz), 3G (e.g., 1.8 GHz, 2.1 GHz), Worldwide Interoperability for Microwave Access (WiMAX) (e.g., 2.3 GHz, 3.3 GHz, 5.7 GHz), wireless Local Area Network (LAN) (e.g., 2.4 GHz), Bluetooth (e.g., 2.4 GHz), Ultra Wide Band (UWB) (e.g., 3.1~10.6 GHz) and the like therein. As described above, when a plurality of antennas are mounted to the wireless communication device, the wireless communication device needs large spaces to place the antennas. The plurality of antennas and installation spaces thereof are important contributing factors associated with increases in product price. Accordingly, small sized and plane typed wideband antennas which can accommodate communication systems of various frequency bands through one antenna have been developed.

In consideration of the trend of recent antenna technologies, a next generation mobile communication system may include a plurality of antennas (the integral antenna is also referred to as an "intenna") within a mobile communication terminal as described above, and an antenna capability reference for minimizing mutual interference between the integral antennas in order to improve quality of a transmitted/received signal becomes more strict. In connection with the above description, installing two or more multi antennas in the mobile communication terminal in order to increase a channel capacity and a signal reliability in 3.5G and 4G systems corresponding to the next generation mobile communication system may be beneficial. Further, in order to mitigate multi-path fading of the mobile communication system, a diversity antenna may be installed in the mobile communication terminal.

According to the related art, wireless communication devices including a plurality of band antenna units include a high frequency antenna unit, a high frequency matching circuit unit, a high frequency band driving circuit unit for processing a high frequency band for each band, a low frequency antenna unit, a low frequency matching circuit unit, and a low frequency band driving circuit unit for processing a low frequency band.

The high frequency antenna unit performs a function of radiating and transmitting a signal suitable for a corresponding high frequency band or receiving a signal, and the high frequency matching circuit unit is connected between the high frequency antenna unit and the high frequency band driving circuit unit to perform an impedance matching function. In addition, the high frequency matching circuit unit matches impedance of the high frequency antenna unit with impedance of the high frequency band driving circuit unit to allow the high frequency antenna unit to maximally receive a radio frequency signal of a desired frequency band. For example, the high frequency matching circuit unit performs impedance matching by using a specific inductor and capacitor, and is generally designed to be suitable for a frequency according to a service provider. The high frequency band driving circuit unit processes various signals transmitted/received in a corresponding high frequency band and is generally implemented in one chip form.

The low frequency antenna unit performs a function of radiating and transmitting a signal suitable for a corresponding low frequency band to the outside or receiving the signal from the outside. The low frequency matching circuit unit is connected between the low frequency antenna unit and the low frequency band driving circuit unit to perform an impedance matching function. The low frequency band driving circuit unit processes various signals transmitted/received in a corresponding low frequency band.

Meanwhile, each of a first antenna unit and a second antenna unit is installed in an upper side of the general wireless communication device including a plurality of antenna units and a third antenna unit is installed in a lower side of the wireless communication device. At this time, the first antenna unit may be a WiFi antenna, the second antenna unit may be a Global Positioning System (GPS) antenna, and the third antenna unit may be a 2G/3G/LTE antenna.

Further, a Near Field Communication (NFC) antenna may be further installed in a back surface of a battery or an internal surface of a battery cover as a fourth antenna unit.

As described above, according to the related art, the general wireless communication device which provides services across a plurality of frequency bands may have a separate antenna unit for each respective frequency band, a separate matching circuit unit, and a separate driving circuit unit for processing suitable for each frequency band. Particularly, an antenna unit which accounts for a significant volume may include an antenna unit having a separate space for each corresponding service (e.g., 3G, LTE, Bluetooth, WiFi, DMB, NFC, and the like). Accordingly, as types of wireless communication services increase and sizes of wireless communication terminals gradually become smaller, an efficient antenna design method for solving the problem associated with narrowing a space in which the antennas are installed is required.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure provides a multi band antenna device which can overcome a problem about a narrow installation space by sharing at least some of antenna units of a first frequency band when configuring an antenna unit of a second frequency band which is a lower frequency band than the first frequency band in a wireless communication device, and a wireless communication device including a multi band antenna.

Another aspect of the present disclosure is to provide a multi band antenna which can overcome a problem about a narrow installation space by sharing at least some of antenna units of a plurality of different frequency bands when configuring an antenna unit of a second frequency band which is a lower frequency band than a first frequency band in a wireless communication device, and a wireless communication device including a multi band antenna.

Another aspect of the present disclosure is to provide a multi band antenna device which can overcome a problem about a narrow installation space by sharing at least some of Multiple Input Multiple Output (MIMO) antenna units when configuring an antenna unit of a second frequency band which is a lower frequency band than a first frequency band in a wireless communication device, and a wireless communication device including a multi band antenna.

Another aspect of the present disclosure is to provide a multi band antenna device which can reduce an antenna installation space within a wireless communication device by connecting an inductor with an antenna unit of a first frequency band to use the antenna unit of the first frequency band as an antenna unit of a second frequency band which is a lower frequency band than the first frequency band in a wireless communication device, and a wireless communication device including a multi band antenna.

In accordance with an aspect of the present disclosure, an antenna device is provided. The antenna device includes a first band antenna unit that communicates a first frequency band signal, a first band driving circuit unit that is connected to the first band antenna unit, and that is configured to perform signal processing of a corresponding first frequency band signal communicated in the first band antenna unit; a second band driving circuit unit that is connected to the first band antenna unit to perform signal processing of a second frequency band signal which has a frequency that is lower than a frequency the first frequency band signal, and a first inductor unit that is connected between one end of the first band antenna unit and the second band driving circuit unit, and that is configured to serve as an inductor.

In accordance with another aspect of the present disclosure, the antenna device may further include a second inductor unit connected between an end of the first band antenna unit to which the first inductor unit is not connected and the second band driving circuit unit, the second inductor unit being configured to serve as an inductor.

In accordance with another aspect of the present disclosure, the antenna device may further include a second band matching circuit unit connected between the first band antenna unit and the second band driving circuit unit, the second band matching circuit unit being configured to perform an impedance matching function.

In accordance with another aspect of the present disclosure, the antenna device may further include a first band matching circuit unit connected between the first band antenna unit and the first band driving circuit unit, the first band matching circuit unit being configured to perform an impedance matching function.

In accordance with another aspect of the present disclosure, an antenna device is provided. The antenna device includes a first band first antenna unit that communicates a first band signal, a first band second antenna unit that communicates the first band signal, a first band driving circuit unit that is connected with the first band first antenna unit and the first band second antenna unit, and that is configured to perform signal processing of a corresponding first band signal communicated in the first band first antenna unit and the first band second antenna unit, a second band driving circuit unit that is connected with the first band first antenna unit and the first band second antenna unit, and that is configured to perform signal processing of a second frequency band signal which has a frequency that is lower than a frequency of a first frequency band signal, and a first inductor unit that is connected between the first band first antenna unit and the second band driving circuit unit, and that is configured to serve as an inductor.

In accordance with another aspect of the present disclosure, the antenna device may further include a second inductor unit connected between the first band second antenna unit and the second band driving circuit unit, the second inductor unit being configured to serve as an inductor.

In accordance with another aspect of the present disclosure, the antenna device may further include a third inductor unit connected between the first band first antenna unit and the first band second antenna unit, the third inductor unit being configured to serve as an inductor.

In accordance with another aspect of the present disclosure, the antenna device may further include a second band matching circuit unit connected between the first band first antenna unit and the first band second antenna unit and the second band driving circuit unit, the second band matching circuit being configured to perform an impedance matching function.

In accordance with another aspect of the present disclosure, the antenna device may further include a first band first matching circuit unit connected between the first band first antenna unit and the first band driving circuit unit, the first band first matching circuit unit being configured to perform an impedance matching function.

In accordance with another aspect of the present disclosure, the antenna device may further include a first band second matching circuit unit connected between the first band second antenna unit and the first band driving circuit unit, the first band second matching circuit unit being configured to perform an impedance matching function.

In accordance with another aspect of the present disclosure, an antenna device is provided. The antenna device includes a first band first antenna unit that communicates a first frequency band signal, a first band second antenna unit that communicates the first frequency band signal, and an inductor unit that is connected between the first band first antenna unit and the first band second antenna unit, and that is configured to serve as an inductor.

In accordance with another aspect of the present disclosure, the inductor unit may include a choke inductor.

In accordance with another aspect of the present disclosure, an antenna device is provided. The antenna device includes a first band antenna unit that communicates a first frequency band signal, a second band antenna unit that communicates a second frequency band signal, a first band driving circuit unit that is connected with the first band antenna unit, and that is configured to perform signal processing of a corresponding first frequency band signal received from the first band antenna unit, a second band driving circuit unit that is connected with the second band antenna unit, and that is configured to perform signal processing of a corresponding second frequency band signal received from the second band antenna unit, a third band driving circuit unit that is connected with the first band antenna unit and the second band antenna unit, and that is configured to perform signal processing of a third frequency band signal which has a frequency that is lower than a frequency of the first frequency band signal and a frequency of the second frequency band signal, and a first inductor unit that is connected between the first band antenna unit and the third band driving circuit unit, and that is configured to serve as an inductor.

In accordance with another aspect of the present disclosure, the antenna device may further include a second inductor unit connected between the first band antenna unit and the second band antenna unit, the second inductor unit being configured to serve as an inductor.

In accordance with another aspect of the present disclosure, the antenna device may further include a third inductor unit connected between the second band antenna unit and the third band driving circuit unit, the third inductor unit being configured to serve as an inductor.

In accordance with another aspect of the present disclosure, the antenna device may further include a third band matching circuit unit connected between the first band antenna unit and the second band antenna unit and the third band driving circuit unit, the third band matching circuit unit being configured to perform an impedance matching function.

In accordance with another aspect of the present disclosure, the antenna device may further include a first band matching circuit unit connected between the first band antenna unit and the first band driving circuit unit, the first band matching circuit unit being configured to perform an impedance matching function.

In accordance with another aspect of the present disclosure, the antenna device may further include a second band matching circuit unit connected between the second band antenna unit and the second band driving circuit unit, the second band matching circuit unit being configured to perform an impedance matching function.

In accordance with another aspect of the present disclosure, a wireless communication device including a multi band antenna is provided. The wireless communication device includes a first band antenna unit that communicates a first frequency band signal, a first band driving circuit unit that is connected with the first band antenna unit, and that is configured to perform signal processing of a corresponding first frequency band signal communicated in the first band antenna unit, a second band driving circuit unit that is connected with the first band antenna unit, and that is configured to perform signal processing of a second frequency band signal which has a frequency that is lower than a frequency the first frequency band signal, a first inductor unit that is connected between one end of the first band antenna unit and the second band driving circuit unit, and that is configured to serve as an inductor, a controller that is connected with the first band driving circuit unit and the second band driving circuit unit, and that is configured to control the first band driving circuit unit and the second band driving circuit unit, and a display unit that displays data processed through the controller in a screen.

In accordance with another aspect of the present disclosure, a wireless communication device including a multi band antenna is provided. The wireless communication device includes a first band first antenna unit that communicates a first band signal, a first band second antenna unit that communicates the first band signal, a first band driving circuit unit that is connected with the first band first antenna unit and the first band second antenna unit, and that is configured to perform signal processing of a corresponding first band signal communicated in the first band first antenna unit and the first band second antenna unit, a second band driving circuit unit that is connected with the first band first antenna unit and the first band second antenna unit, and that is configured to perform signal processing of a second frequency band signal which has a frequency that is lower than a frequency of the first frequency band signal, a first inductor unit that is connected between the first band first antenna unit and the second band driving circuit unit, and that is configured to serve as an inductor, a controller that is connected with the first band driving circuit unit and the second band driving circuit unit, and that is configured to control the first band driving circuit unit and the second band driving circuit unit, and a display unit that displays data processed through the controller in a screen.

In accordance with another aspect of the present disclosure, a wireless communication device including a multi band antenna is provided. The wireless communication device includes a first band antenna unit that communicates a first frequency band signal, a second band antenna unit that communicates a second frequency band signal, a first band driving circuit unit that is connected with the first band antenna unit, that is configured to perform signal processing of a corresponding first frequency band signal received from the first band antenna unit, a second band driving circuit unit that is connected with the second band antenna unit, that is configured to perform signal processing of a corresponding second frequency band signal received from the second band antenna unit, a third band driving circuit unit that is connected with the first band antenna unit and the second band antenna unit, and that is configured to perform signal processing of a third frequency band signal which has a frequency that is lower than a frequency of the first frequency band signal and a frequency of the second frequency band signal, and a first inductor unit that is connected between the first band antenna unit and the third band driving circuit unit, and that is configured to serve as an inductor, a controller that is connected with the first band driving circuit unit and the second band driving circuit unit, and that is configured to control the first band driving circuit unit and the second band driving circuit unit, and a display unit that displays data processed through the controller in a screen.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
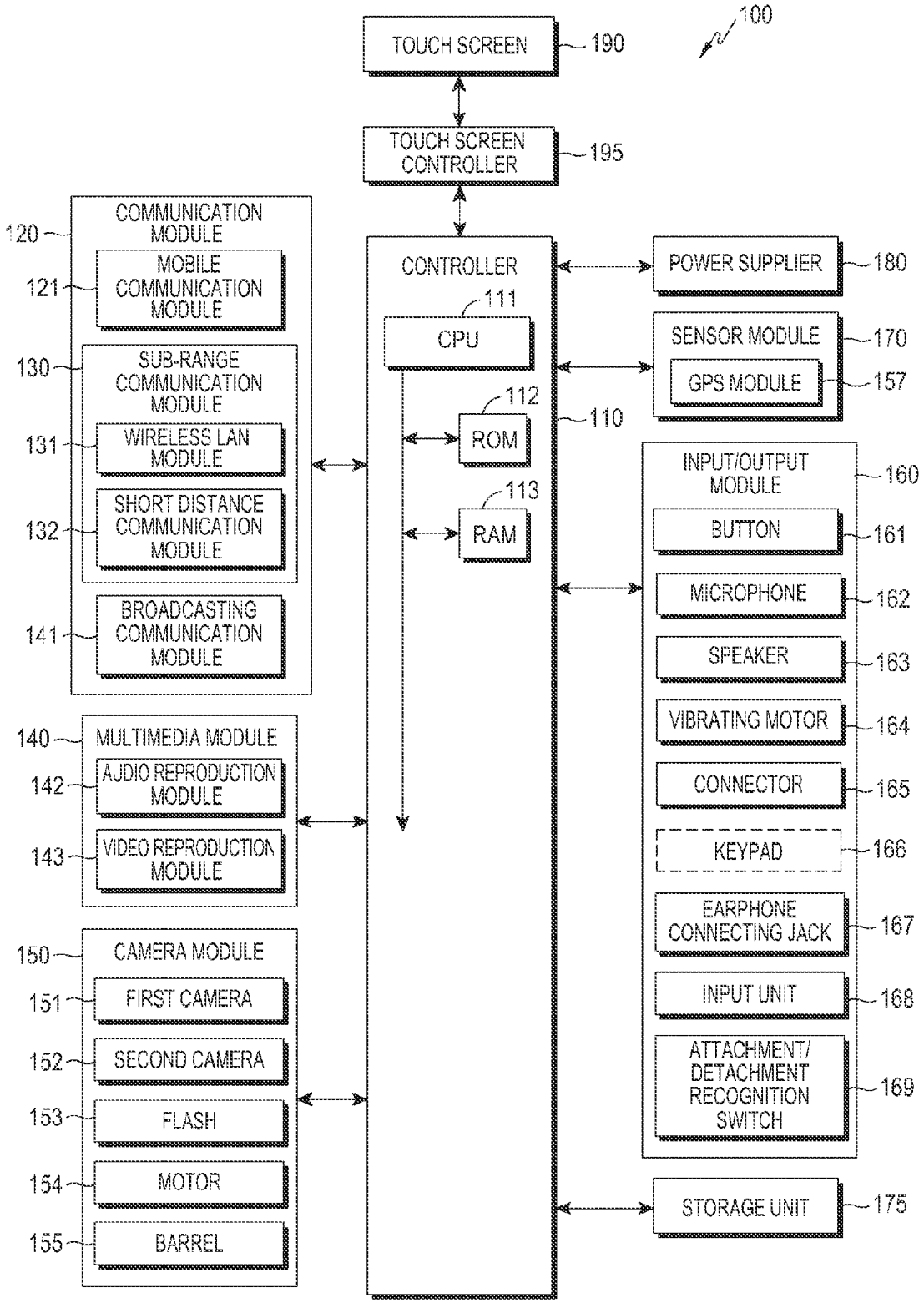
FIG. 1 is a block diagram schematically illustrating an example of a portable terminal as a wireless communication device according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the spirit and scope of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

As a non-exhaustive illustration only, a terminal described herein may refer to mobile devices such as a cellular phone, a Personal Digital Assistant (PDA), a digital camera, a portable game console, an MP3 player, a Portable/Personal Multimedia Player (PMP), a handheld e-book, a tablet PC, a portable lap-top PC, a Global Positioning System (GPS) navigation, and devices such as a desktop PC, a high definition television (HDTV), an optical disc player, a set-top box, and the like capable of wireless communication or network communication consistent with that disclosed herein.

Various embodiments of the present disclosure disclose an antenna device which shares at least some of antennas of a first frequency band for transmitting/receiving a signal of the first frequency band corresponding to a relatively high frequency band when configuring an antenna unit of a second frequency band for transmitting/receiving a signal of the second frequency band corresponding to a relatively low frequency band in configuring an antenna unit for transmitting/receiving signals of a plurality of frequency bands within a wireless communication device, and a wireless communication device including antennas.

Meanwhile, a high frequency or a low frequency does not correspond to a specific frequency band, but rather corresponds to a relative concept for comparing two different frequency bands in various embodiments of the present disclosure which will be described below. For example, according to an embodiment of the present disclosure, a lower frequency antenna unit for transmitting/receiving a relatively low frequency band signal shares a high frequency antenna unit for transmitting/receiving a high frequency band signal, so that spaces within which the antenna units are installed in the wireless communication device can be reduced.

According to an embodiment of the present disclosure, one high frequency antenna unit may be shared as the low frequency antenna unit, or two or more high frequency antenna units may be shared as the low frequency antenna unit. For example, two or more high frequency antennas of different frequency bands may be shared as the low frequency antenna unit, or two or more high frequency antenna units of the same frequency band may be shared as the low frequency antenna unit.

In order to realize such various embodiments of the present disclosure, a low frequency band antenna unit may be implemented by connecting an inductor (e.g., a choke inductor) with a high frequency band antenna unit in serial. Accordingly, the low frequency band antenna unit may be implemented by sharing the high frequency band antenna unit and adjusting a length of an inductor or a circuit board for the antenna unit of the required remaining lengths.

Accordingly, efficiently reducing spaces occupied by antennas within the wireless communication device (for example, a smart phone, a base station, or a device or circuit to be connected to another device) having two or more antennas therein such as an antenna for WCDMA communication, an antenna for LTE communication, an antenna for WIFI communication, an antenna for GPS communication, an antenna for NFC, and/or the like may be possible. Further, according to an embodiment of the present disclosure, one antenna unit can simultaneously radiate different bands by applying an inductor or an additional circuit while using in common an injection carrier for radiation and a radiation pattern for a plurality of antenna units. Accordingly, by sharing different high frequency antennas in common without separately designing an antenna of a relatively low frequency band such as NFC, Frequency Modulation (FM), Digital Multimedia Broadcasting (DMB), and/or the like, the wireless communication device can be designed to enable simultaneous radiations.

Further, the "antenna unit" described below corresponds to an object having a predetermined form which radiates a signal to a radio space to transmit the signal or receive the signal through the radio space and generally corresponds to a radiator. However, various embodiments of the present disclosure are not limited thereto. In addition, the "antenna unit" may perform only a transmission function or a reception function, or may perform both a transmission function and a reception function. According to various embodiments of the present disclosure described below, performance of only the transmission or reception function or performance of both functions may be collectively referred to as "communication".

Hereinafter, various embodiments of the present disclosure will be described in detail with reference to the accompanying drawings in order to easily implement the various embodiments of the present disclosure by those skilled in the art.

First, a structure of the wireless communication device including an antenna unit according to an embodiment of the present disclosure will be described with reference to FIG. 1.

FIG. 1 is a block diagram schematically illustrating a portable terminal as an example of a wireless communication device according to an embodiment of the present disclosure.

Referring to FIG. 1, a portable terminal 100 may include a controller 110, a communication module 120, a multimedia module 140, a camera module 150, an input/output module 160, a sensor module 170, a storage unit 175, a power supplier 180, a touch screen 190, and a touch screen controller 195.

The portable terminal 100 can be connected with an external electronic device (not shown) by using one of a communication module 120, a connector 165, and an earphone connecting jack 167. The electronic device includes one of various devices such as an earphone, an external speaker, a Universal Serial Bus (USB) memory, a charger, a cradle/dock, a DMB antenna, a mobile payment related device, a health management device (e.g., blood sugar tester, or the like), a game machine, a car navigation device, and/or the like which can attached to the portable terminal 100 through a wire and removable from the portable terminal 100. Further, the electronic device may include a Bluetooth communication device, a Near Field Communication (NFC) device, a WiFi Direct communication device, a wireless Access Point (AC), and/or the like which can be wirelessly connected. In addition, the portable terminal 100 can be connected with another portable terminal or an electronic device, for example, one of a mobile phone, a smart phone, a tablet PC, a desktop PC, a server, and/or the like.

The communication module 120 includes a mobile communication module 121, a sub communication module 130, and a broadcasting communication module 141. The sub communication module 130 includes at least one of a wireless LAN module 131 and a short distance communication module 132.

The multimedia module 140 includes at least one of an audio reproduction module 142 and a video reproduction module 143.

The camera module 150 includes at least one of a first camera 151 and a second camera 152. The camera module 150 may also include a flash 153, a motor 154, a barrel 155, and/or the like.

The input/output module 160 includes at least one of a button 161, a microphone 162, a speaker 163, a vibration device 164, a connector 165, a keypad 166, and/or the like. The input/output module 160 may also include an input unit 168, an attachment/detachment recognition switch 169, and/or the like.

The controller 110 includes a CPU 111, a Read-Only memory (ROM) 112 storing a control program for controlling the portable terminal 100, and a Random-Access Memory (RAM) 113 used as a storage area for storing a signal or data input from the outside of the portable terminal 100 or for storing work performed in the portable terminal 100 (e.g., data created within the portable terminal 100). The CPU 111 may include a various number of cores. For example, the CPU 111 may include a single core, a dual core, a triple core, a quadruple core, or the like. The CPU 111, the ROM 112, and the RAM 113 can be mutually connected to each other through an internal bus.

According to various embodiments of the present disclosure, the controller 110 can control the communication module 120, the multimedia module 140, the camera module 150, the input/output module 160, the sensor module 170, the storage unit 175, the power supplier 180, the touch screen 190, and the touch screen controller 195.

According to various embodiments of the present disclosure, a user input may include a gesture input through the camera module 150, a switch/button input through the button 161 or the keypad 166, and a voice input through the microphone 162, a user input through the touch screen 190, and/or the like.

Further, the controller 110 can detect a user input even such as a hovering event as the input unit 168 approaches the touch screen 190 or is located close to the touch screen 190. The controller 110 can perform a preset program operation (e.g., switching of an input mode or a function execution mode) corresponding to the user input event when the user input event is generated according to a preset scheme.

The controller 110 can output a control signal to the input unit 168 or the vibration device 164. The control signal may include information on a vibration pattern and the input unit 168 or the vibration device 164 generates a vibration according to the vibration pattern. The information on the vibration pattern may indicate the vibration pattern itself or an indicator of the vibration pattern. Alternatively, the control signal may include only a request for generating the vibration.

The portable terminal 100 may include at least one of the mobile communication module 121, the wireless LAN module 131, and the short distance communication module 132 according to a capability thereof. Each of the wireless communication modules is connected with an antenna unit to wirelessly communicate.

According to an embodiment of the present disclosure, because at least one antenna unit is shared, an installation space occupied by antennas within the portable terminal 100 may be reduced.

The mobile communication module 121 enables the portable terminal 100 to be connected with an external electronic device through mobile communication by using one or more antennas (not shown) according to a control of the controller 110. The mobile communication module 121 can transmit/receive a wireless signal for voice phone communication, a video call, a video call, a Short Message Service (SMS), or a Multimedia Message Service (MMS) to/from a mobile phone (not shown), a smart phone (not shown), a tablet PC, or another electronic device (not shown) having a phone number input into the portable terminal 100.

The sub communication module 130 includes at least one of the wireless LAN module 131 and the short distance communication module 132. For example, the sub communication module 130 may include only the wireless LAN module 131, may include only the short distance communication module 132, or may include both the wireless LAN module 131 and the short distance communication module 132.

The wireless LAN module 131 can be Internet-connected according to a control of the controller 110 in a place in which a wireless Access Point (AP) (not shown) is installed. The wireless LAN module 131 supports a wireless LAN standard of the Institute of Electrical and Electronics Engineers (e.g., IEEE 802.11x). The short distance communication module 132 can wirelessly perform near field communication between the portable terminal 100 and an image forming apparatus (not shown) according to a control of the controller 110. A short distance communication scheme may include Bluetooth, Infrared Data Association (IrDA) communication, WiFi-Direct communication, Near Field Communication (NFC), and/or the like.

The broadcasting communication module 141 can receive a broadcasting signal (e.g., a TV broadcasting signal, a radio broadcasting signal, or a data broadcasting signal) and broadcasting supplement information (e.g., an Electric Program Guide (EPG), an Electric Service Guide (ESG), or the like) output from a broadcasting station through a broadcasting communication antenna (not shown) according to a control of the controller 110.

The multimedia module 140 includes the audio reproduction module 142 or the video reproduction module 143. The audio reproduction module 142 can reproduce a digital audio file (e.g., a file having a file extension of mp3, wma, ogg, way, or the like) stored or received according to a control of the controller 110. The video reproduction module 143 can reproduce a digital video file (e.g., a file having a file extension of mpeg, mpg, mp4, avi, mov, mkv, or the like) stored or received according to a control of the controller 110.

The multimedia module 140 may be integrated in the controller 110. The camera module 150 includes at least one of the first camera 151 and the second camera 152 for photographing a still image or a video according to a control of the controller 110. Further, the camera module 150 includes at least one of a barrel 155 performing a zoom in/zoom out for photographing a subject, a motor 154 for controlling a motion of the barrel 155, and a flash 153 for providing a light source required for photographing the subject. The first camera 151 may be disposed on a front surface of the apparatus 100, and the second camera 152 may be disposed on a back surface of the apparatus 100.

The input/output module 160 may include at least one button 161, at least one microphone 162, at least one speaker 163, at least one vibration device 164, the connector 165, keypad 166, the earphone connection jack 167, the input unit 168, and/or the like. According to various embodiments of the present disclosure, the input/output module 160 is not limited thereto, and may include a mouse, a trackball, a joystick, a cursor control such as cursor direction keys, or the like for controlling a motion of a cursor on the touch screen 190.

The button 161 may be formed on a front surface, a side surface, or a back surface the housing of the portable terminal 100, and may include at least one of a power/lock button, a volume button, a menu button, a home button, a back button, and a search button. The microphone 162 receives a voice or a sound to generate an electrical signal according to a control of the controller 110. The speaker 163 can output sounds corresponding to various signals or data (e.g., wireless data, broadcasting data, digital audio data, digital video data, and/or the like) to the outside of the portable terminal 100 according to a control of the controller 110. The speaker 163 can output a sound (e.g., button tone corresponding to phone communication, ringing tone, and a voice of another user) corresponding to a function performed by the portable terminal 100. One speaker 163 or a plurality of speakers 163 may be formed on a suitable position or positions of the housing of the portable terminal 100.

The vibration device 164 can convert an electrical signal to a mechanical vibration according to a control of the controller 110. For example, when the portable terminal 100 in a vibration mode receives a voice or video call from another device (not shown), the vibration device 164 operates. One vibration device 164 or a plurality of vibration devices 164 may be formed within the housing of the portable terminal 100. The vibration device 164 may operate in accordance with a user input through the touch screen 190.

The connector 165 may be used as an interface for connecting the portable terminal 100 with an external electronic device or a power source (not shown). The controller 110 can transmit or receive data stored in the storage unit 175 of the portable terminal 100 to or from an external electronic device through a wired cable connected to the connector 165. The portable terminal 100 can receive power from the power source through the wired cable connected to the connector 165 or charge a battery (not shown) by using the power source.

The keypad 166 can receive a key input from the user for the control of the portable terminal 100. The keypad 166 includes a physical keypad (not shown) formed in the portable terminal 100 or a virtual keypad (not shown) displayed on the touch screen 190. The physical keypad (not shown) formed in the portable terminal 100 may be excluded according to a capability or structure of the portable terminal 100. An earphone (not shown) is inserted into the earphone connecting jack 167 to be connected with the portable terminal 100.

The input unit 168 may be inserted into the inside of the portable terminal 10 and withdrawn or separated from the portable terminal 100 when being used. An attachment/detachment recognition switch 169 which works in accordance with an installation and attachment/detachment of the input unit 168 is located in one area within the portable terminal 100 into which the input unit 168 is inserted, and the attachment/detachment recognition switch 169 can output signals corresponding to the installation and separation of the input unit 168 to the controller 110. The attachment/detachment recognition switch 169 may be configured to directly/indirectly contact the input unit 168 when the input unit 168 is mounted. Accordingly, the attachment/detachment recognition switch 169 can generate the signal corresponding to the installation or the separation of the input unit 168 (e.g., signal informing of the installation or the separation of the input unit 168) and output the generated signal to the controller 110 based on whether the attachment/detachment recognition switch 169 contacts the input unit 168.

The sensor module 170 includes at least one sensor for detecting a state of the portable terminal 100. For example, the sensor module 170 includes at least one of a proximity sensor for detecting whether the user approaches the portable terminal 100, an illumination sensor (not shown) for detecting an amount of ambient light of the portable terminal 100, a motion sensor (not shown) for detecting a motion (e.g., rotation, acceleration, or vibration of the portable terminal 100) of the portable terminal 100, a geo-magnetic sensor for detecting a point of the compass by using the Earth's magnetic field, a gravity sensor for detecting a gravity action direction, an altimeter for measuring an atmospheric pressure to detect an altitude, and a GPS module 157.

The GPS module 157 can receive radio waves from a plurality of GPS satellites (not shown) in Earth's orbit and calculate a position of the portable terminal 100 by using Time of Arrival from the GPS satellites to the portable terminal 100.

The storage unit 175 can store a signal or data input/output according to the operation of the communication module 120, the multimedia module 140, the camera module 150, the input/output module 160, the sensor module 170, or the touch screen 190. The storage unit 175 can store a control program and applications for controlling the portable terminal 100 or the controller 110.

The term "storage unit" is used as a term which refers to a random data storage device such as the storage unit 175, the ROM 112 or the RAM 113 within the controller 110, or a memory card (e.g., a Secure Digital (SD) card, a memory stick, or the like) installed in the portable terminal 100. The storage unit 175 may include a non-volatile memory, a volatile memory, or a Hard Disk Drive (HDD), a Solid State Drive (SSD), and/or the like.

Further, the storage unit 175 can store images for providing applications having various functions such as a navigation, a video call, a game and an alarm application based on time and Graphical User Interfaces (GUIs) related to the applications, databases or data related to a method of processing user information, a document, and a touch input, background images (menu screen, standby screen and the like) required for driving the portable terminal 100, operating programs, or images photographed by the camera module 150.

The storage unit 175 is a non-transitory machine-readable medium (e.g., non-transitory computer readable storage medium), and the term of the machine-readable medium may be defined as a medium for providing data to the machine to perform a specific function. The storage unit 175 includes a non-volatile medium and a volatile medium. All such media should be a type in which commands transmitted by the media can be detected by a physical mechanism reading the commands through a machine.

The machine-readable medium is not limited thereto and includes at least one of a floppy disk, a flexible disk, a hard disk, a magnetic tape, a Compact Disk Read-Only Memory (CD-ROM), an optical disk, a punch card, a paper tape, a Read-Only Memory (RAM), a Programmable ROM (PROM), an Erasable PROM (EPROM), a flash-EPROM, and/or the like.

The power supplier 180 can supply power to one battery or a plurality of batteries arranged at the housing of the portable terminal 100 according to a control of the controller 110. The one battery or the plurality of batteries supply power to the portable terminal 100 and/or a peripheral device connected thereto. Further, the power supplier 180 can supply power input from an external power source through a wired cable connected to the connector 165 to the portable terminal 100. In addition, the power supplier 180 can supply power wirelessly input from the external power source through a wireless charging technology to the portable terminal 100.

The portable terminal 100 includes at least one touch screen 190 providing user graphical interfaces corresponding to various services (e.g., a phone call, a data transmission, a broadcast, and an image capture) to the user. The touch screen 190 can output an analog signal corresponding to at least one user input into the user graphical interface to the touch screen controller 195.

The touch screen 190 can receive at least one user input through a user's body (e.g., fingers including a thumb, and/or the like) or the input unit 168 (e.g., a stylus pen, an electronic pen, and/or the like). The touch screen 190 may be implemented in a resistive type, a capacitive type, an infrared type, an acoustic wave type, or a combination thereof.

Further, the touch screen 190 includes at least two touch panels which can detect touches or approaches of the finger and the input unit 168, respectively, in order to receive inputs of the finger and the input unit 168, respectively. The at least two touch panels provide different output values to the touch screen controller 195, and the touch screen controller 195 differently recognizes the values input from the at least two touch screen panels to determine whether the input from the touch screen 190 is the input by the finger or the stylus pen.

In addition, the touch is not limited to a touch between the touch screen 190 and a touch means. For example, the touch may include a non-contact (e.g., a case in which an interval between the touch screen 190 and the user's body or the touch means is 1 mm or shorter). The detectable interval of the touch screen 190 may be changed according to a capability or structure of the portable terminal 100.

The touch screen controller 195 converts an analog signal received from the touch screen 190 to a digital signal and transmits the converted digital signal to the controller 110. The controller 110 can control the touch screen 190 by using the digital signal received from the touch screen controller 195. The touch screen controller 195 can identify a hovering interval or distance as well as a position of the user input by detecting a value (e.g., a current value or the like) output through the touch screen 190, convert the identified distance value to a digital signal (e.g., a Z coordinate), and then provide the converted digital signal to the controller 110. Further, the touch screen controller 190 can detect a pressure applied to the touch screen 190 by the user input means by detecting the value (e.g., the current value, or the like) output through the touch screen 190, convert the identified pressure value to a digital signal, and then provide the converted digital signal to the controller 110.

Hereinafter, a structure of an antenna device according to various embodiments of the present disclosure will be described in detail with reference to FIGS. 3 to 5.

Figure 3:
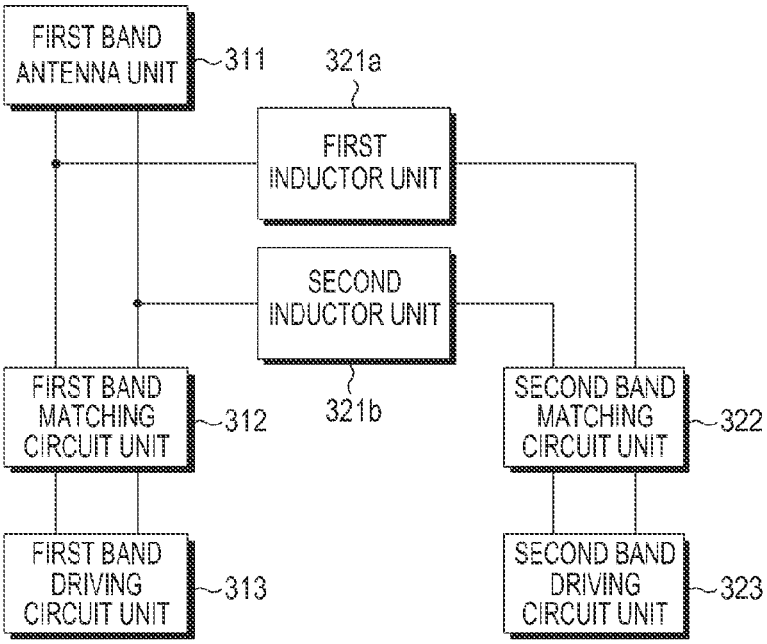
FIG. 3 is a block diagram illustrating a structure of a multi band antenna device according to a first embodiment of the present disclosure.

FIG. 3 is a block diagram illustrating a structure of a multi band antenna device according to a first embodiment of the present disclosure.

Referring to FIG. 3, the multi band antenna device may be, for example, a dual band antenna device. According to the first embodiment of the present disclosure, the antenna device includes a first band antenna unit 311, a first band matching circuit unit 312, a first band driving circuit unit 313, a second band matching unit 322, and a second band driving circuit unit 323.

A first frequency band may be a high frequency which is relatively higher than a second frequency band, and the second frequency band may be a low frequency which is relatively lower than the first frequency band. For example, a first frequency band signal may be a signal of WCDMA, LTE, Bluetooth, WiFi, and GPS, and a second frequency band signal may be a signal of NFC. However, various embodiments of the present disclosure are not limited to signals of the above bands.

According to an embodiment of the present disclosure, a second band antenna unit may be configured without a conventional separate antenna unit by connecting the second band matching circuit unit 322 and the first band antenna unit 311 in serial through a first inductor unit 321*a* and/or a second inductor unit 321*b*. For example, as the first band antenna unit 311, the first inductor unit 321*a*, and/or the second inductor unit 321*b* perform functions of the second band antenna unit, a corresponding second band frequency signal can be transmitted/received. The first inductor unit 321*a* and/or the second inductor unit 321*b* may be implemented by any device having an inductance component. For example, the inductor unit may include a coil, an inductor, a chock inductor, a bead, and/or the like.

Meanwhile, the first frequency band signal received through the first band antenna unit 311 is transmitted to the first band driving circuit unit 313 through the first band matching circuit unit 312. When a connection circuit between the first band antenna unit 311 and the second band matching circuit unit 322 is considered as an open circuit by adjusting inductance values of the first inductor unit 312*a* and the second inductor unit 321*b*, a first band frequency signal component is not transmitted to the second band matching circuit unit 322. Accordingly, the first band antenna unit 311, the first band matching circuit unit 312, and the first band driving circuit unit 313 which are associated with the function of processing the first band signal are not influenced by the second band matching circuit 322 and the second band driving circuit unit 323.

In contrast, a second frequency band signal received through the first band antenna unit 311 is transmitted to the second matching circuit unit 322 through the first inductor unit 321*a* and the second inductor unit 321*b*. For example, the first band antenna unit 311, the first inductor unit 321*a*, and the second inductor unit 321*b* have a totally predetermined length in the second frequency band, and the corresponding components may perform the same functions as those of the second band antenna unit. Accordingly, the second band antenna unit can be implemented by adjusting and correcting an entire length of an antenna pattern of the first band antenna unit 311 by an inductor and a pattern (e.g., a Flexible Printed Circuit Board (FPCB) wire) on a Printed Circuit Board (PCB).

Further, although FIG. 3 illustrates that the antenna device according to the first embodiment of the present disclosure includes the first inductor unit 321*a* and the second inductor unit 321*b*, one of the first inductor unit 321*a* and the second inductor unit 321*b* may be selectively included in the antenna device, or both the first inductor unit 321*a* and the second inductor unit 321*b* may be included in the antenna device.

Meanwhile, the first inductor unit 321*a* or the second inductor unit 321*b* may be implemented by using a choke inductor. However, various embodiments of the present disclosure are not limited thereto. For example, any device which can perform the same or similar function to that of the inductor may be included in the inductor units 321*a* and 321*b* according to the embodiment of the present disclosure.

In FIG. 3, the first band signal may be a signal of WCDMA, LTE, Bluetooth, WiFi, or GPS and the second band signal may be a signal of NFC, DMB, or FM according to the first embodiment of the present disclosure as described above, but the present disclosure is not limited to signals of the above bands.

Figure 4:
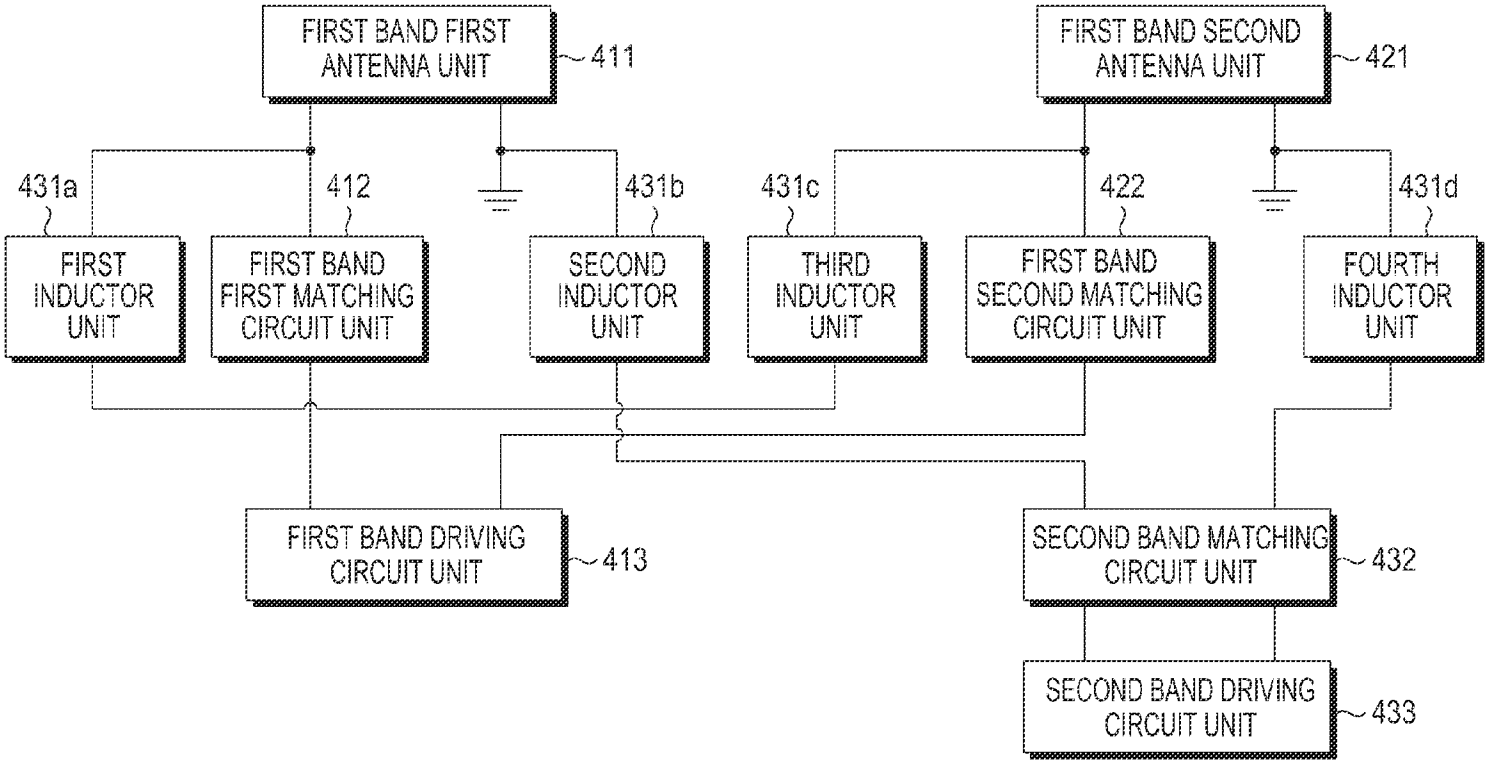
FIG. 4 is a block diagram illustrating a structure of a multi band antenna device according to a second embodiment of the present disclosure.

FIG. 4 is a block diagram illustrating a structure of a dual band antenna device according to a second embodiment of the present disclosure.

Referring to FIG. 4, the antenna device according to the second embodiment of the present disclosure includes a first band first antenna unit 411, a first band first matching circuit unit 412, a first band driving circuit unit 413, a first band second antenna unit 421, a first band second matching circuit unit 422, a second band matching circuit unit 432, and a second band driving circuit unit 433.

According to various embodiments of the present disclosure, the second band antenna unit may be configured without a conventional separate second band antenna unit by connecting the second band matching circuit unit 432 with the first band first antenna unit 411 and the first band second antenna unit 421 in serial through a first inductor unit 4321*a*, a second inductor unit 431*b*, a third inductor unit 431*c*, and a fourth inductor unit 431*d*. For example, as the first band first antenna unit 411, the first band second antenna unit 421, and the first inductor unit 4321*a* to the fourth inductor unit 431*d* perform functions of the second band antenna unit, a corresponding second frequency band signal can be radiated.

Meanwhile, first frequency band signals received through the first band first antenna unit 411 and the first band second antenna unit 421 are transmitted to the first band driving circuit unit 413 through the first matching circuit unit 412 and the first band second matching circuit unit 422, respectively. When a connection circuit between the first band first antenna unit 411 or the first band second antenna unit 421 and the second band matching circuit unit 432 in the corresponding first frequency band is considered as an open circuit by adjusting inductance values of the first inductor unit 431*a* to the fourth inductor unit 431*d*, a first band frequency signal component is not transmitted to the second band matching circuit unit 432. Accordingly, the first band first antenna unit 411, the first band second antenna unit 421, the first band first matching circuit unit 412, the first band second matching circuit unit 422, and the first band driving circuit unit 413 which are associated with the function of processing the first frequency band signal are not influenced by the second band matching circuit unit 432 and the second band driving circuit unit 433.

In contrast, a signal received through the first band first antenna unit 411 or the first band second antenna unit 421 may be transmitted to the second band matching circuit unit 432 through the first inductor unit 431*a* to the fourth inductor unit 431*d* connected with each other in serial. For example, because the first band first antenna unit 411, the first band second antenna unit 421, and the first inductor unit 431*a* to the fourth inductor unit 431*d* have a predetermined length, the corresponding components can perform the same functions as those of the second band antenna unit.

For example, as illustrated in FIG. 4, the second inductor unit 431*b*, the first band first antenna unit 411, the first inductor unit 431*a*, the third inductor unit 431*c*, the first band second antenna unit 421, and the fourth inductor unit 431 are sequentially connected in serial. Accordingly, the second frequency band antenna unit can be implemented without a separate second band antenna unit by adjusting and correcting an entire length of an antenna pattern of the first band first antenna unit 411 and the first band second antenna unit 421 with an inductor and a pattern (FPCB wire) on a PCB.

Further, although FIG. 4 illustrates that the first inductor unit 431*a* to the fourth inductor unit 431*d* are included in the antenna device according to the second embodiment of the present disclosure, at least one of the first inductor unit 431*a* to the fourth inductor unit 431*d* may be selectively included in the antenna device. In addition, the first inductor unit 431*a* and the third inductor unit 413*c* connected with the first inductor unit 431*a* in serial may be implemented by one inductor unit. For example, the third inductor unit 431*c* may be omitted.

Meanwhile, the first inductor unit 431*a* to the fourth inductor unit 431*d* may be implemented by using a choke inductor, but the present disclosure is not limited thereto. For example, any device which can perform the same or similar function to that of the inductor may be included in the inductor units 431*a* to 431*d* according to an embodiment of the present disclosure.

According to the second embodiment of the present disclosure, the first frequency band signal may be a signal of WCDMA, LTE, Bluetooth, WiFi, or GPS, and the second frequency band signal may be a signal of NFC. However, the present disclosure is not limited to signals of the above bands. Further, in the second embodiment of the present disclosure, two first band antenna units of the same frequency band exist to form a MIMO antenna. Accordingly, for example, an NFC antenna unit may share a WiFi MIMO antenna included in the wireless communication device. For example, when the WiFi MIMO antenna is configured, as one side of a tablet terminal includes a first WiFi antenna and the other side includes a second WiFi antenna, the NFC antenna may be implemented by connecting the first WiFi antenna and the second WiFi antenna through the inductor as illustrated in FIG. 4.

For example, because a band difference between two frequency bands including a WiFi frequency band ranging from 2.4 GHz to 5 GHz and an NFC frequency band corresponding to 13.5 MHz is large, a circuit can be implemented as illustrated in FIG. 4.

Figure 5:
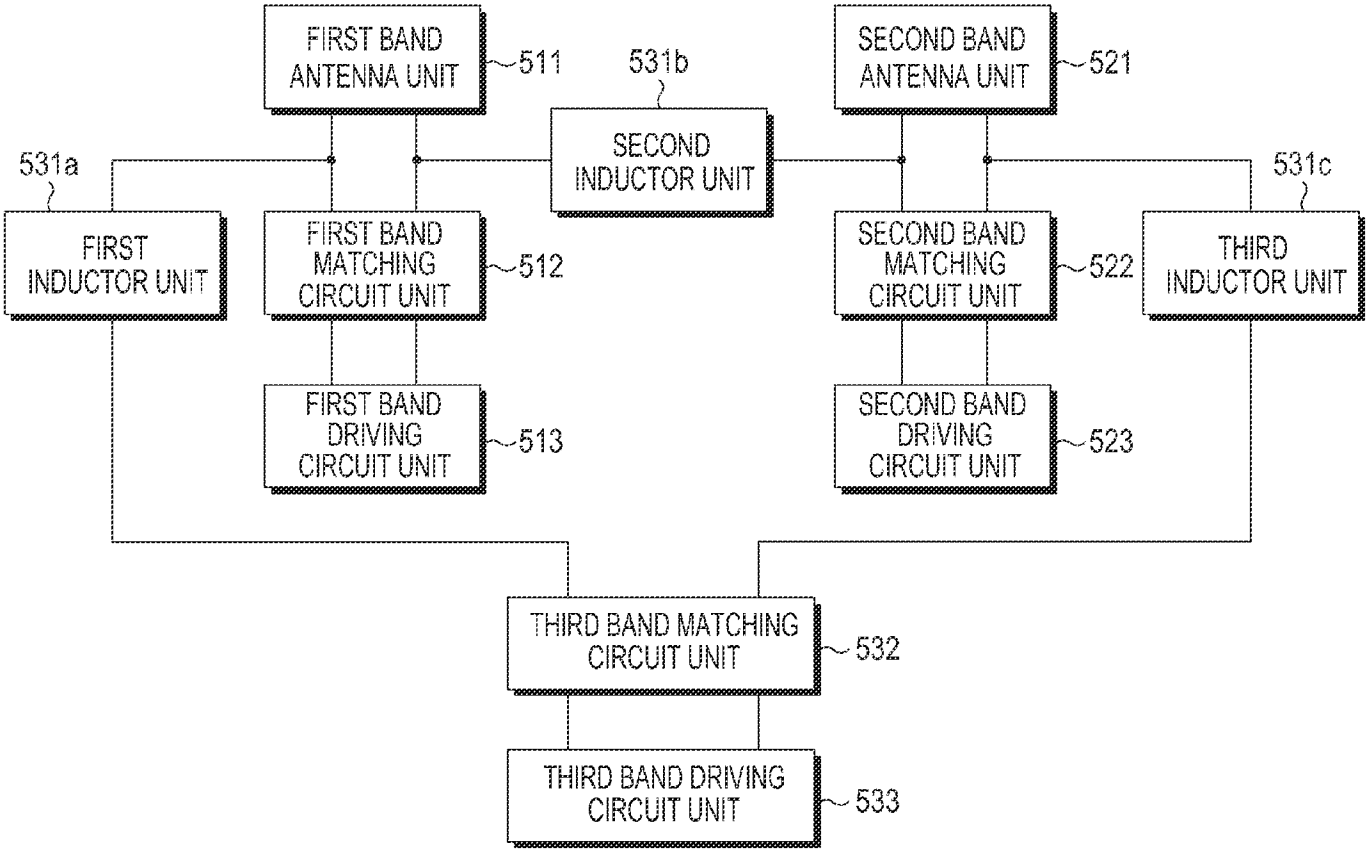
FIG. 5 is a block diagram illustrating a structure of a multi band antenna device according to a third embodiment of the present disclosure.

FIG. 5 is a block diagram illustrating a structure of a multi band antenna device according to a third embodiment of the present disclosure.

Referring to FIG. 5, the antenna device according to the third embodiment of the present disclosure includes a first band antenna unit 511, a first band matching circuit unit 512, a first band driving circuit unit 513, a second band antenna unit 521, a second band matching circuit unit 522, a second band driving circuit unit 523, a third band matching circuit unit 532, and a third band driving circuit unit 533. Meanwhile, although the second embodiment of the present disclosure illustrated in FIG. 4 implements an antenna unit of a different frequency band (e.g., relatively low frequency band) by sharing the MIMO antenna unit of the same frequency band (e.g., relatively high frequency band), the third embodiment of the present disclosure illustrated in FIG. 5 implements an antenna unit of a different frequency band (for example, low frequency antenna unit) by sharing two antenna units of different frequency bands.

According to the third embodiment of the present disclosure, a third band antenna unit may be configured without a conventional separate third frequency band antenna unit by connecting the third band matching circuit unit 532 with the first band antenna unit 511 and the second band antenna unit 521 in serial through the first inductor unit 531*a* and the third inductor unit 531*c*. Further, the third band antenna unit which shares the first band antenna unit 511 and the second band antenna unit 521 can be implemented by connecting the second inductor unit 531*b* between the first band antenna unit 511 and the second band antenna unit 521. For example, a corresponding second frequency band signal can be radiated because the first band antenna unit 511, the second band antenna unit 521, and the first inductor unit 531*a*, the second inductor unit 531*b*, and the third inductor unit 531*c* perform functions of the third band antenna unit.

Meanwhile, a first frequency band signal and a second frequency band signal received through the first band antenna unit 511 and the second band antenna unit 521 are transmitted to the first band driving circuit unit 513 and the second band driving circuit unit 523 through the first band matching circuit unit 512 and the second band matching circuit unit 522, respectively. When a connection circuit between the first band antenna unit 511 or the second band antenna unit 521 and the third band matching circuit unit 532 is considered as an open circuit in the corresponding first frequency band and second frequency band by adjusting inductance values of the first inductor unit 531*a* to the third inductor unit 531*c*, a first band frequency signal component or a second band signal component is not transmitted to the third band matching circuit unit 532.

Accordingly, the first band antenna unit 511, the second band antenna unit 521, the first band matching circuit unit 512, the second band matching circuit unit 522, the first band driving circuit unit 513, and the second band driving circuit unit 523 which are associated with the function of processing the first and second frequency band signals are not influenced by the third band matching circuit unit 532 and the third band driving circuit unit 533.

In contrast, a third frequency band signal received through the first band antenna unit 511 or the second band antenna unit 521 is transmitted to the third band matching circuit unit 532 through the first inductor unit 531*a* to the third inductor unit 531*c*. For example, because the first band antenna 411, the second band antenna unit 521, and the first inductor unit 531*a* to the third inductor unit 531*c* have a predetermined length in the third frequency band, the corresponding components can perform the same function as that of the third band antenna unit.

For example, as illustrated in FIG. 5, the first inductor unit 531*a*, the first band antenna unit 511, the second inductor unit 531*b*, the second band antenna unit 521, and the third inductor unit 531*c* are sequentially connected in serial. Accordingly, the third frequency band antenna unit can be implemented without a separate third frequency band antenna unit by adjusting and correcting an entire length of an antenna pattern of the first band antenna unit 541 and the second band antenna unit 521 with an inductor and a pattern (FPCB wire) on a PCB.

Further, although FIG. 5 illustrates that the first inductor unit 531*a* to the third inductor unit 531*c* are included in the antenna device according to the third embodiment of the present disclosure, at least one of the first inductor unit 531*a* to the third inductor unit 531*c* may be selectively included in the antenna unit.

Meanwhile, the first inductor unit 531*a* to the third inductor unit 531*c* may be implemented by using a choke inductor. However, various embodiments of the present disclosure are not limited thereto. For example, any device which can perform the same or similar function to that of the inductor may be included in the inductor units 531*a* to 531*c* according to an embodiment of the present disclosure.

Each of the first frequency band signal or the second frequency band signal may be a signal of WCDMA, LTE, Bluetooth, WiFi, or GPS, and the third frequency band signal may be a signal of NFC. However, the present disclosure is not limited to signals of the above bands. Further, in the third embodiment of the present disclosure, two band antenna units of different bands exist to form first and second band antenna units. Accordingly, for example, an NFC antenna unit may share and use an LTE or 3G antenna unit and a WiFi antenna unit included in the wireless communication device. For example, in a smart phone, when first and second band antennas are configured such that one side of the terminal includes the LTE antenna and the other side includes the WiFi antenna, the NFC antenna of a relatively low frequency band (e.g., third band) can be implemented by connecting the LTE antenna and the WiFi antenna through the inductor as illustrated in FIG. 5.

Meanwhile, although FIGS. 4 and 5 describes the embodiment of implementing the antenna unit of the different frequency band (e.g., relatively low frequency band) by sharing two antenna units of the same frequency band or different frequency bands, the antenna unit of the different frequency band (e.g., relatively low frequency band) can be implemented by sharing three or more frequency band antenna units based on the same principle. For example, the low frequency antenna unit can be configured by sharing three or more high frequency antenna units through a connection between the low frequency matching circuit unit and at least one high frequency antenna unit by the inductor unit and connections between a plurality of high frequency antenna units by the inductor units.

Figure 2:
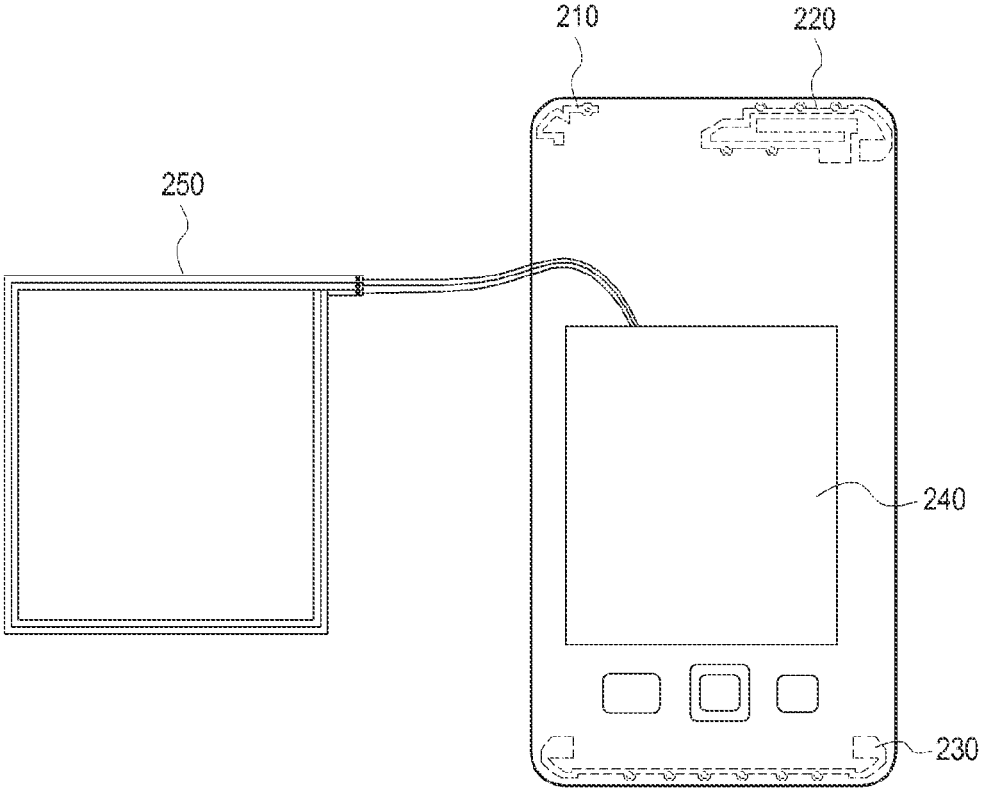
FIG.2 (RELATED ART)
FIG. 2 is a diagram schematically illustrating an internal structure of a wireless communication device including a plurality of antennas according to an embodiment of the related art.
Figure 6:
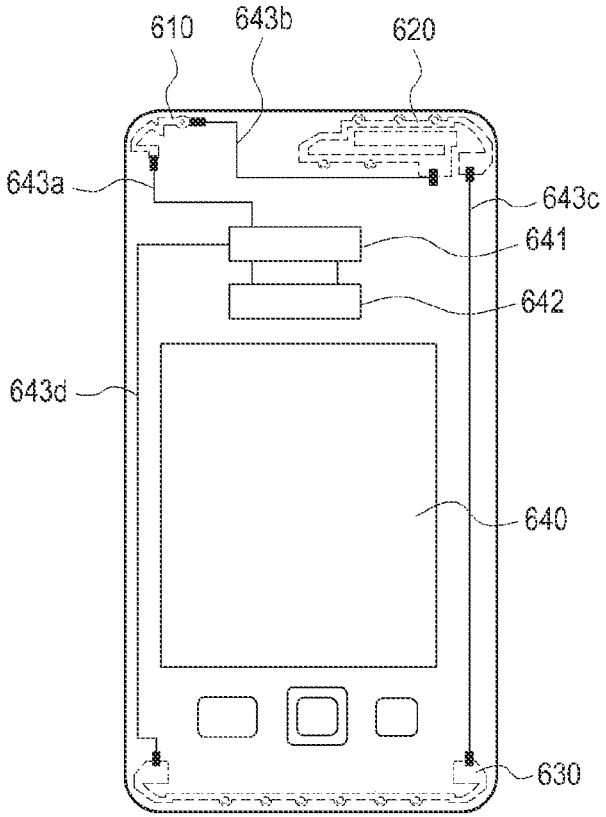
FIGS. 6 and 7 are diagrams illustrating an electronic device including a plurality of antennas according to an embodiment of the present disclosure.
Figure 7:
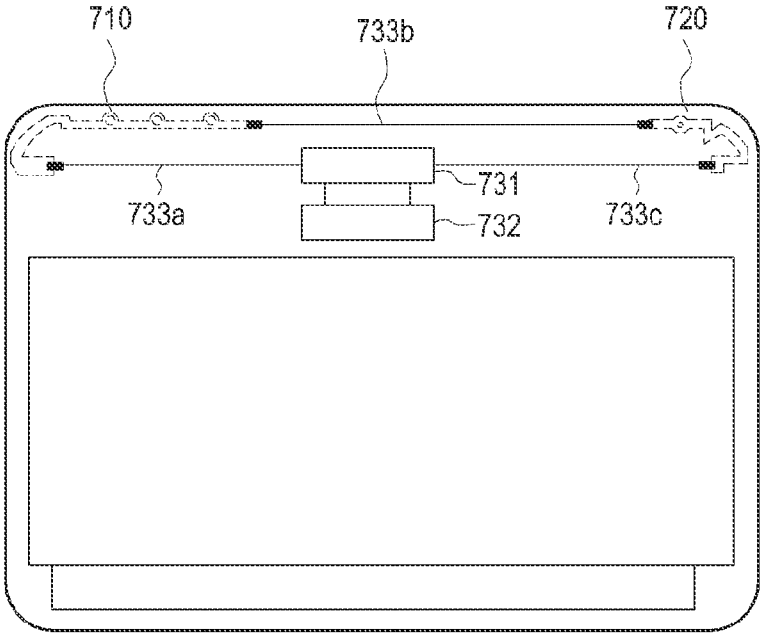

FIGS. 6 and 7 are diagrams illustrating a wireless communication device including a plurality of antennas according to an embodiment of the present disclosure. FIG. 2 is a diagram schematically illustrating an internal structure of a wireless communication device including a plurality of antennas according to the related art.

Referring to FIG. 6, the wireless communication device will be described in comparison with the wireless communication device of FIG. 2. Like in FIG. 2, a first antenna unit 610 and a second antenna unit 620 are located in an upper part of the wireless communication device and a third antenna unit 630 is located in a lower part. The first antenna unit 610 may be a WiFi antenna, the second antenna unit 620 may be a Global positioning System (GPS) antenna, and the third antenna unit 630 may be a 2G/3G/LTE antenna.

Referring to FIG. 2, a first antenna unit 210 and a second antenna unit 220 are located in an upper part of the wireless communication device and a third antenna unit 230 is located in a lower part. The first antenna unit 210 may be a WiFi antenna, the second antenna unit 220 may be a Global positioning System (GPS) antenna, and the third antenna unit 230 may be a 2G/3G/LTE antenna. Further, a Near Field Communication (NFC) antenna may be further located in a back surface of a battery 240 or an internal surface of a battery cover as a fourth antenna unit 250.

Accordingly, referring to FIG. 6, unlike the wireless communication device of FIG. 2, the NFC antenna is not included in a battery 640 as the fourth antenna unit which is a relatively low frequency antenna in comparison with the first to third frequency bands. Rather, the fourth antenna unit may be implemented by sharing the first antenna unit 610, the second antenna unit 620, and the third antenna unit 630 according to an embodiment of the present disclosure.

For example, a fourth band matching circuit unit 641 (e.g., an NFC matching circuit unit) is connected with a fourth band driving circuit unit 642 (e.g., an NFC driving circuit unit). Further, the fourth band matching circuit unit 641 is not connected with a separate fourth band antenna unit, but is connected with the first antenna unit 610 through a first inductor unit 643*a* according to an embodiment of the present disclosure. The first antenna unit 610 may be connected with the second antenna unit 620 through a second inductor unit 643*b*, and the second antenna unit 620 may be connected with the third antenna unit 630 through a third inductor unit 643*c*. The fourth antenna unit may be generated by sharing the first antenna unit 610, the second antenna unit 620, and the third antenna unit 630. Further, the fourth antenna unit be configured by connecting the third antenna unit 630 with the fourth band matching circuit unit 641 through the fourth inductor unit 643*d*.

Accordingly, the space in which the plurality of antennas are installed may be efficiently used by implementing the low frequency antenna unit occupying relatively large volume of the wireless communication device which should have a plurality of antennas therein through sharing the high frequency antenna unit as shown in FIG. 6.

Similarly, referring to FIG. 7, a first antenna unit 710 is located in one upper side of the wireless communication device such as a tablet terminal and a second antenna unit 720 is located in the other upper side. The first antenna unit 710 may be an LTE or 3G antenna, and the second antenna unit 720 may be a WiFi antenna.

According to an embodiment of the present disclosure, a Near Field Communication (NFC) antenna may be implemented as the third antenna unit by sharing the first antenna unit 710 and the second antenna unit 720.

For example, a third band matching circuit unit 731 (e.g., an NFC matching circuit unit) is connected with a third band driving circuit unit 732 (e.g., an NFC driving circuit unit). Further, the third band matching circuit unit 731 is not connected with a separate third band antenna unit, but is connected with the first antenna unit 710 through a first inductor unit 733*a* according to an embodiment of the present disclosure. Because the first antenna unit 710 is connected with the second antenna unit 720 through a second inductor unit 733*b* and the second antenna unit 620 is connected with the third band matching circuit unit 731 through a third inductor unit 733*c*, the third band antenna unit may be configured by sharing the first antenna unit 710 and the second antenna unit 720.

Accordingly, as illustrated in FIGS. 6 and 7, when an antenna pattern according to the various embodiments of the present disclosure is used, an NFC antenna which can perform simultaneous radiations through a front side and a back side of the wireless communication device can be implemented.

Figure 8:
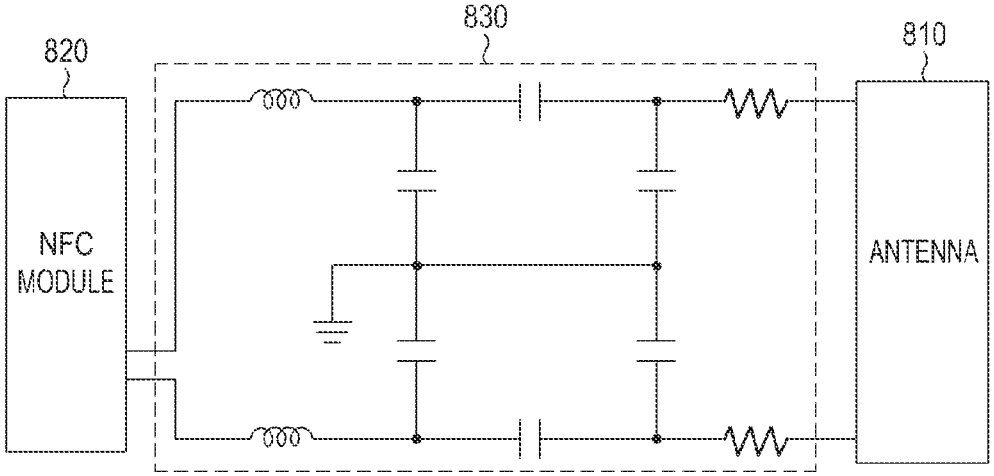
FIG. 8 is a diagram illustrating a matching circuit unit according to an embodiment of the present disclosure.

FIG. 8 is a diagram illustrating a matching circuit unit according to an embodiment of the present disclosure.

Referring to FIG. 8, according to various embodiments of the present disclosure, an NFC matching circuit unit 830 may be located between an NFC module 820 and an antenna 810. The NFC matching circuit unit 830 may selectively include a plurality of coils, condensers, and resistors as shown in FIG. 8. Meanwhile, according to the embodiment of the present disclosure as described above, the antenna 810 is not implemented by the separate low frequency antenna unit, but is implemented by sharing the high frequency antennas through a connection between the high frequency antennas by the inductors.

For example, according to various embodiments of the present disclosure, when an inductor ranging from 47 nH to 56 nH is applied, the inductor is considered as an open circuit in a high frequency band such as LTE, 3G, WiFi, or the like and is considered as an antenna unit having a predetermined length in a low frequency band such as NFC. Accordingly, as described above, the antenna of the low frequency band such as NFC can be implemented by adjusting or correcting the length by the conventional antenna pattern, inductor, or pattern on the PCB (FPCB wire).

According to various embodiments of the present disclosure, the problem associated with the need to reduce the narrow installation space of the wireless communication device can be removed by sharing at least some of antenna units of the high frequency band when the antenna unit of the low frequency band is configured in the wireless communication device.

Further, according to various embodiments of the present disclosure, the problems associated with the need to reduce the narrow installation space can be removed and antenna manufacturing costs can be reduced by simultaneously radiating signals through sharing at least some of antennas without designing separate antennas for each band having different frequency band in the wireless communication device.

In addition, according to the various embodiments of present disclosure, signals of different frequency bands can be simultaneously radiated through one antenna by using an injection carrier for radiation and a radiation pattern through one antenna in common and applying an inductor or an additional circuit in the wireless communication device including two or more antennas. Accordingly, designing an antenna of a low frequency band at the same time as designing an antenna of a high frequency band may be possible.

While the present disclosure has shown and described with reference to various embodiments thereof, it will be understood by those skilled in the art that various changes in form and details may be made therein without departing from the spirit and scope of the present disclosure as defined by the appended claims and their equivalents.

What is claimed is:

1. An antenna device comprising:

a first band antenna unit that is configured to communicate a first frequency band signal;

a first inductor unit that is connected between one end of the first band antenna unit and a third band driving circuit unit, and that is configured to transmit the first frequency band signal or a second frequency band signal to the third band driving circuit unit according to inductance values;

a second band antenna unit that is configured to communicate a second frequency band signal;

a first band driving circuit unit that is connected with the first band antenna unit, and that is configured to perform signal processing of a corresponding first frequency band signal received from the first band antenna unit;

a second band driving circuit unit that is connected with the second band antenna unit, and that is configured to perform signal processing of a corresponding second frequency band signal received from the second band antenna unit; and the third band driving circuit unit that is connected with the first band antenna unit and the second band antenna unit, and that is configured to perform signal processing of a third frequency band signal which has a frequency that is lower than a frequency of the first frequency band signal and a frequency of the second frequency band.

2. The antenna device of claim 1, further comprising: a second inductor unit connected between the first band antenna unit and the second band antenna unit, the second inductor unit being configured to serve as an inductor.

3. The antenna device of claim 1, further comprising: a third inductor unit connected between the second band antenna unit and the third band driving circuit unit, the third inductor being configured to serve as an inductor.

4. The antenna device of claim 1, further comprising: a third band matching circuit unit connected between the first band antenna unit and the second band antenna unit and the third band driving circuit unit, the third band matching circuit unit being configured to perform an impedance matching function.

5. The antenna device of claim 1, further comprising: a first band matching circuit unit connected between the first band antenna unit and the first band driving circuit unit, the first band matching circuit unit being configured to perform an impedance matching function.

6. The antenna device of claim 1, further comprising: a second band matching circuit unit connected between the second band antenna unit and the second band driving circuit unit, the second band matching circuit unit being configured to perform an impedance matching function.

7. A wireless communication device comprising a multi band antenna, the wireless communication device comprising;

a first band antenna unit that is configured to communicate a first frequency band signal;

a first inductor unit that is connected between one end of the first band antenna unit and a third band driving circuit unit, and that is configured to transmit the first frequency band signal and a second frequency band signal to the third band driving circuit unit according to inductance values;

a second band antenna unit that is configured to communicate a second frequency band signal;

a first band driving circuit unit that is connected with the first band antenna unit, and that is configured to perform signal processing of a corresponding first frequency band signal received from the first band antenna unit;

a second band driving circuit unit that is connected with the second band antenna unit, and that is configured to perform signal processing of a corresponding second frequency band signal received from the second band antenna unit;

the third band driving circuit unit that is connected with the first band antenna unit and the second band antenna unit, and that is configured to perform signal processing of a third frequency band signal which has a frequency that is lower than a frequency of the first frequency band signal and a frequency of the second frequency band signal;

a controller that is connected with the first band driving circuit unit and the second band driving circuit unit, and that is configured to control the first band driving circuit unit and the second band driving circuit unit; and a display unit that is configured to display data processed through the controller in a screen.

* * * * *